US010194509B2

(12) United States Patent
Jorgensen

(10) Patent No.: US 10,194,509 B2
(45) Date of Patent: Jan. 29, 2019

(54) LIGHTING SYSTEM CONTROLLER

(71) Applicant: Angela Jorgensen, Chicago, IL (US)

(72) Inventor: Angela Jorgensen, Chicago, IL (US)

( * ) Notice: Subject to any disclaimer, the term of this patent is extended or adjusted under 35 U.S.C. 154(b) by 0 days.

(21) Appl. No.: 15/496,139

(22) Filed: Apr. 25, 2017

(65) Prior Publication Data

US 2017/0325321 A1 Nov. 9, 2017

Related U.S. Application Data

(60) Provisional application No. 62/333,320, filed on May 9, 2016.

(51) Int. Cl.
*H05B 37/02* (2006.01)
*F21V 21/15* (2006.01)
*G08C 17/02* (2006.01)

(52) U.S. Cl.
CPC ..... *H05B 37/0272* (2013.01); *G08C 17/02* (2013.01); *G08C 2201/93* (2013.01)

(58) Field of Classification Search
CPC ..... H05B 37/0272; F21V 21/45
USPC ..... 315/292
See application file for complete search history.

(56) References Cited

U.S. PATENT DOCUMENTS 6,530,838 B2 * 3/2003 Ha ..... A63F 13/06 345/169
D492,294 S 6/2004 Kim
7,432,803 B2 10/2008 Fails et al.
7,580,728 B2 8/2009 Vance et al.
7,653,771 B2 * 1/2010 Liberty ..... G06F 1/1632 463/37
7,967,483 B2 6/2011 Lee
9,407,100 B2 * 8/2016 Joynes ..... H02J 7/0042
9,529,447 B2 * 12/2016 Hodges ..... G06F 1/1632
9,539,507 B2 * 1/2017 Schoenith ..... A63F 13/24
9,711,980 B2 * 7/2017 Hodges ..... H02J 7/0042
9,872,369 B2 * 1/2018 Julian ..... H05B 37/0272
2006/0252537 A1 * 11/2006 Wu ..... A63F 13/06 463/36
2006/0286943 A1 * 12/2006 Vance ..... A63F 13/06 455/90.1
2012/0238363 A1 * 9/2012 Watanabe ..... H04N 21/472 463/31
2013/0095925 A1 * 4/2013 Xu ..... G06F 1/1626 463/37
2013/0109476 A1 * 5/2013 Baum ..... A63F 13/92 463/37
2014/0094309 A1 * 4/2014 Osawa ..... A63F 13/06 463/37
2016/0254864 A1 * 9/2016 Mueller ..... H04B 10/116 398/118

(Continued)

*Primary Examiner* — Dylan C White
(74) *Attorney, Agent, or Firm* — Global Intellectual Property Agency, LLC; Daniel Boudwin

(57) ABSTRACT

A lighting system controller. The lighting system controller includes a housing, a power supply, a wireless transceiver configured to send signals to and receive signals from a lighting system via a wireless network, a recessed area disposed on the housing, the recessed area adapted to removably secure a smartphone therein, and a plurality of buttons, each button of the plurality of buttons configured to control an individual operation of the lighting system. The smartphone display is configured to display properties of the lighting system, such as the position and brightness of individual lights.

8 Claims, 2 Drawing Sheets

(56) References Cited

U.S. PATENT DOCUMENTS

2017/0290132 A1* 10/2017 Amrine ..... H05B 33/0845

* cited by examiner

LIGHTING SYSTEM CONTROLLER

CROSS REFERENCE TO RELATED APPLICATIONS

This application claims the benefit of U.S. Provisional Application No. 62/333,320 filed on May 9, 2016. The above identified patent application is herein incorporated by reference in its entirety to provide continuity of disclosure.

FIELD OF THE INVENTION

The present invention relates to lighting system controllers. More specifically, the present invention provides a wireless controller that receives a smartphone for controlling a lighting system.

BACKGROUND OF THE INVENTION

Lighting systems used in entertainment lighting applications, such as stage shows, sporting events, public events, and the like, are typically complex systems that utilize broad varieties of stationary and moving lights to produce various lighting effects. In such lighting systems, the individual lights are typically connected to a central control console via control cables. The console is utilized to control various parameters of the individual lights of the lighting system. For example, the brightness, horizontal position, and vertical position of one or more lights can be adjusted if desired. The control console can control operation and adjust parameters of individual lights and can also program multiple lights to behave in a desired manner.

While it is advantageous to have the ability to control various parameters of individual lights via a single central console, it is not without drawbacks. For example, installation of the control cables is a difficult, expensive, and time-consuming process. The consoles are typically unable to be easily transported, so they can only be used in a single location and not used elsewhere without going through the arduous tasks of disassembling and transporting the console. In addition, the control cables limit the applications and use of lighting devices due to the restrictions in the location and length of the cables. Furthermore, the cables contaminate an operating space of a show and may constitute a personnel and public safety hazard. It is therefore desirable to provide a lighting system controller that can wirelessly control a lighting system.

Devices have been disclosed in the known art relating to lighting controllers. There exist mobile devices such as smartphones that are capable of wirelessly controlling a lighting system. However, users may have a difficult time utilizing a smartphone's touchscreen to control the lighting system without additional physical buttons due to the layout and complexity of the controls. Another device discloses a means of wirelessly controlling a lighting system in conjunction with a central wired console. However, this device still utilizes the expensive and bulky console that cannot be easily moved if needed.

In light of the devices disclosed in the known art, it is submitted that the present invention substantially diverges in design elements from the known art and consequently it is clear that there is a need in the art for an improvement to existing lighting system controllers. In this regard the present invention substantially fulfills these needs.

SUMMARY OF THE INVENTION

In view of the foregoing disadvantages inherent in the known types of lighting system controllers now present in the prior art, the present invention provides a wireless lighting control system wherein the same can be utilized for providing convenience for the user when wirelessly controlling a lighting system with a smartphone. The present system comprises a housing, a power supply, a wireless transceiver configured to send signals to and receive signals from a lighting system via a wireless network, a recessed area disposed on the housing, the recessed area adapted to removably secure a smartphone therein, and a plurality of buttons, each button of the plurality of buttons configured to control an individual operation of the lighting system. The smartphone display is configured to display properties of the lighting system, such as the position and brightness of individual lights.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
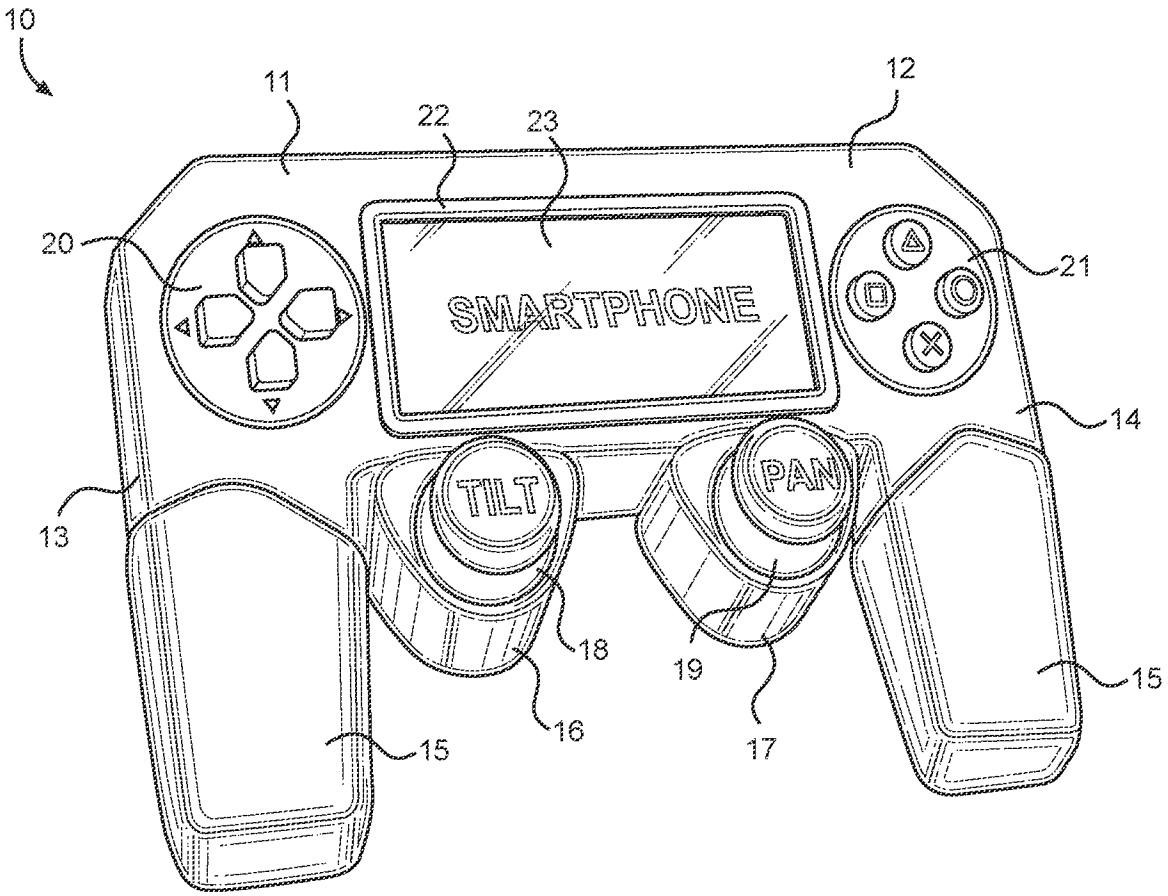
FIG. 1 shows a perspective view of the lighting system controller.

Reference is made herein to the attached drawings. Like reference numerals are used throughout the drawings to depict like or similar elements of the lighting system. For the purposes of presenting a brief and clear description of the present invention, the preferred embodiment will be discussed as used for wirelessly controlling a lighting system. The figures are intended for representative purposes only and should not be considered to be limiting in any respect.

Referring now to FIG. 1, there is shown a perspective view of the lighting system controller. The lighting system controller 10 comprises a handheld controller 11 having a housing 12 shaped to be easily held by the users. The housing 12 includes a first handle 13 on one side thereof and a second handle 14 on an opposing side thereof, defining an open middle portion therebetween. In the illustrated embodiment, each handle 13, 14 includes a grip 15 thereon. The grip 15 allows a user to hold the controller 11 comfortably and prevents the controller 11 from slipping from the user's grasp.

A recessed area 22 is disposed on a center portion of the housing 12. The recessed area 22 is configured to receive a mobile device, shown as a smartphone 23 in the illustrated embodiment, such that the display screen of the smartphone 23 faces outward. When secured within the recessed area 22, the smartphone 23 is operably connected to the controller 11, such that the hardware and software of the smartphone 23 power the various controls of the controller 11. Further, the smartphone 23 displays various properties, parameters, and conditions of the lighting system for the user. The smartphone 23 can be removably secured within the recessed area 22 via a friction fit. In one embodiment, the smartphone display is flush with the outer surface of the housing 12 when the smartphone is secured within the recessed area 22.

The controller 10 further comprises a plurality of buttons configured to control various functions of the lighting system. In the illustrated embodiment, the plurality of buttons includes a first group of buttons 20 and a second group of buttons 21 disposed on opposing sides of the recessed area 22. Additionally, the controller 11 includes a first joystick 18 disposed within a first joystick housing 16 extending downward from a lower portion of the controller housing 12. A second joystick 19 is disposed within a second joystick housing 17, which is positioned adjacent to the first joystick housing 16. The first joystick 18 is configured to control the tilt of an individual light of the lighting system by adjusting the position of the individual light along a vertical plane. The second joystick 19 is configured to control the pan of an individual light of the lighting system by adjusting the position of the individual light along a horizontal plane.

Figure 2:
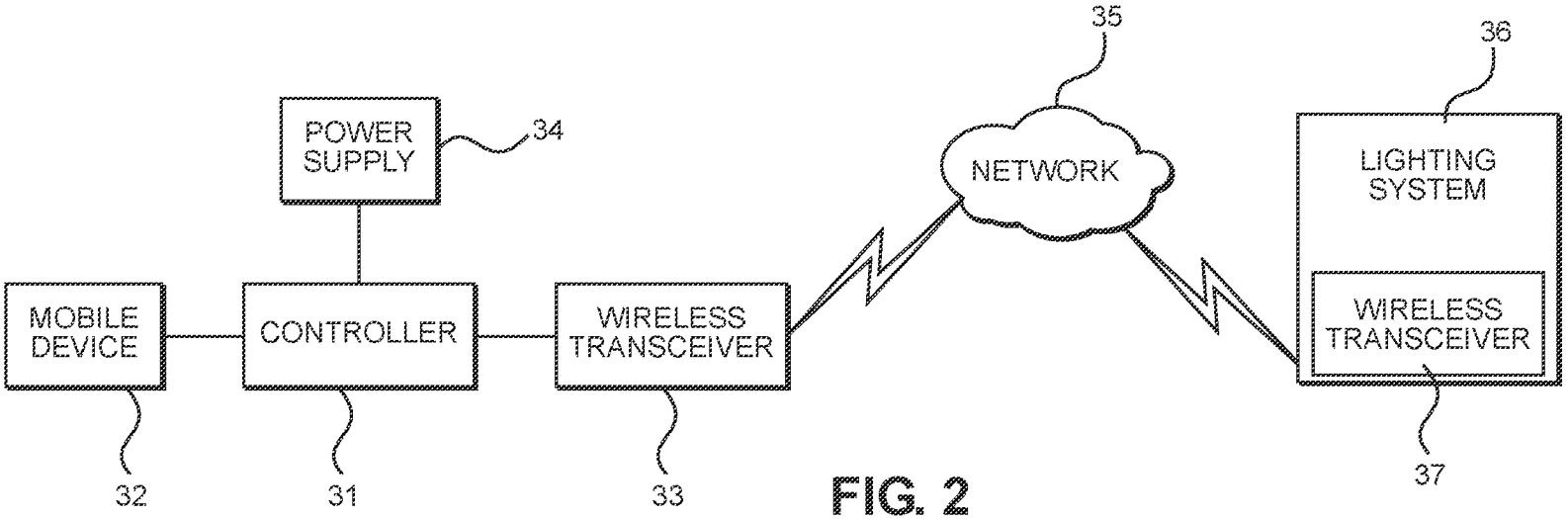
FIG. 2 shows a diagram of the lighting system controller and a lighting system.

Referring now to FIG. 2, there is shown a diagram of the lighting system controller and a lighting system. The lighting system can include one or more lights that are each capable of performing individual operation. In one operation example, each light can be are configured to be movable along an x, y, and z axis so that they can be positioned as desired. The lighting system can further include one or more lights having various properties that can be controlled individual operation via a command signal, such as brightness, focal length, etc.

The controller 31 further comprises a power supply 34, such as a rechargeable battery, which provides power to the various components thereof. The lighting system controller 31 additionally comprises a wireless transceiver 33 which is operably connected to the mobile device 32. The wireless transceiver 33 is configured to send signals to and receive signals from a corresponding wireless transceiver 37 that is operably connected to a lighting system 36. The signals are sent and received via a network 35, such as a Bluetooth or Wi-Fi network.

In use, the user selects which parameters of the lighting system 36 to control via the plurality of buttons. The selected parameters and current properties of the lighting system can be displayed on the mobile device 32. The properties displayed can include brightness, focal length, position, and the like. The plurality of buttons are then utilized to adjust the desired parameters of desired individual lights. For example, if the user wishes to adjust the tilt of an individual light, the user actuates the corresponding joystick. The software of the mobile device 32 then causes the wireless transceiver 33 to transmit a corresponding signal to the wireless transceiver 37 of the lighting system 36, which receives the signal and causes the tilt of the selected light to be adjusted.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A controller, comprising:

a housing;

a power supply disposed within the housing;

a first wireless transceiver configured to communicate with a lighting system via a wireless network; a recessed area disposed on the housing, the recessed area adapted to removably secure a smartphone therein; and a plurality of buttons, each button of the plurality of buttons configured to control an individual operation of the lighting system, a first joystick configured to control the position of one or more lights of a lighting system along a vertical plane, wherein movement of the first joystick is configured to cause the first wireless transceiver to transmit a first signal to a second wireless transceiver of the lighting system and move the one or more lights of the lighting system in a first direction;

a second joystick configured to adjust the position of one or more lights of a lighting system along a horizontal plane, wherein movement of the second joystick is configured to cause the first wireless transceiver to transmit a second signal to a second wireless transceiver of the lighting system and move the one or more lights of the lighting system in a second direction.

2. The controller of claim 1, wherein the smartphone is removably securable within the recessed area via a friction fit.

3. The controller of claim 1, wherein a display of the smartphone is configured to display one or more properties of the lighting system.

4. The controller of claim 1, wherein the plurality of buttons comprises a first group of buttons disposed adjacent a first side of the recessed area and a second group of buttons disposed adjacent a second side of the recessed area.

5. The controller of claim 1, further comprising:

a pair of handles defining an open area therebetween.

6. The controller of claim 4, further comprising:

a grip disposed on each handle of the pair of handles.

7. The controller of claim 1, wherein the power supply comprises a rechargeable battery.

8. A wirelessly controllable lighting system, comprising:

one or more lights operably connected to a first wireless transceiver;

a controller comprising a first joystick, a second joystick, a second wireless transceiver and a recessed area disposed on the housing, the recessed area adapted to removably secure a smartphone therein;

wherein the controller is configured to operate the one or more lights via communication between the first wireless transceiver and the second wireless transceiver over a wireless network, wherein movement of the first joystick is configured to cause the second wireless transceiver to transmit a first signal to the first wireless transceiver and move the one or more lights in a first direction;

wherein movement of the second joystick is configured to cause the second wireless transceiver to transmit a second signal to the first wireless transceiver and move the one or more lights in a second direction.

* * * * *